US005493826A

United States Patent [19]

Keller et al.

[11] Patent Number: 5,493,826

[45] Date of Patent: Feb. 27, 1996

[54] INSULATING LIGHT TRANSMITTING FLAT STRUCTURE PANEL PROVIDING THE ILLUSION OF A THREE-DIMENSIONAL ARRAY OF STEP-LIKE BLOCK STRUCTURES, AND METHOD OF CONSTRUCTING THE SAME

[75] Inventors: Robert R. Keller; Samuel F. Keller, both of Bedford, N.H.

[73] Assignee: Kalwall Corporation, Manchester, N.H.

[21] Appl. No.: 121,299

[22] Filed: Sep. 14, 1993

[51] Int. Cl.[6] ..... E06B 3/66; E06B 3/673

[52] U.S. Cl. ..... 52/204.59; 52/311.1; 52/793.11; 52/794.1; 156/63; 156/100; 428/14; 428/38; 428/117

[58] Field of Search ..... 52/204.59, 311.1, 52/314, 783.1, 793.1, 793.11, 794.1; 156/63, 99, 100, 278; 428/14, 38, 45, 46, 117

[56] References Cited

U.S. PATENT DOCUMENTS

| | | | |
|---|---|---|---|
| 2,210,806 | 8/1940 | Etbauer . | |
| 2,981,382 | 4/1961 | Keller | 52/311.1 X |
| 3,193,434 | 7/1965 | Weiss . | |
| 3,226,903 | 1/1966 | Lillethun | 52/204.59 X |
| 3,568,387 | 3/1971 | Grabow . | |
| 3,940,896 | 3/1976 | Steel . | |
| 4,145,858 | 3/1979 | Dovman | 52/204.59 X |
| 4,294,875 | 10/1981 | Schramm | 428/72 |
| 4,471,596 | 9/1984 | Deaton et al. . | |
| 4,516,197 | 5/1985 | Yonkers . | |
| 4,583,338 | 4/1986 | Sewell et al. | 52/806 X |
| 4,684,571 | 8/1987 | Kunnert et al. | 428/314.8 |
| 4,726,973 | 2/1988 | Thompson | 428/45 |
| 4,877,308 | 10/1989 | Okuno et al. . | |
| 4,894,974 | 1/1990 | Mayhew et al. | 52/807 X |
| 5,157,892 | 10/1992 | Ryther | 52/785 |
| 5,251,417 | 10/1993 | Yates, Jr. | 52/311.1 X |

*Primary Examiner*—Carl D. Friedman
*Assistant Examiner*—Kevin D. Wilkens
*Attorney, Agent, or Firm*—Rines and Rines

[57] ABSTRACT

A novel "three-dimensional" appearing light-transmitting and insulating sandwich panel of planar outer facing sheets in which the illusion of a three-dimensional array of step-like block structures is produced by periodic light transmission contrasting blocks containing, internally of the panel, contrasting light-transmitting insulation filler battes in alternate blocks, and method of constructing the same.

21 Claims, 2 Drawing Sheets

INSULATING LIGHT TRANSMITTING FLAT STRUCTURE PANEL PROVIDING THE ILLUSION OF A THREE-DIMENSIONAL ARRAY OF STEP-LIKE BLOCK STRUCTURES, AND METHOD OF CONSTRUCTING THE SAME

The present invention relates to light-transmitting structural panels, preferably having temperature-insulating qualities so as to be useful to serve as walls or roofs of homes and other buildings or structures, being more particularly directed to novel techniques for constructing sandwich panels that, while actually flat, provide the illusion of a three-dimensional array of step-like block structures throughout the panel.

BACKGROUND OF THE INVENTION

Light-transmitting insulating structural sandwich panels have been successfully used as decorative and functional walls and roofs of building structures for some years, as embodied, for example, in previous patents and products of Kalwall Corporation, also the assignee of the present application, such as U.S. Pat. Nos. 4,642,949 and 4,774,790.

Through selection of surfacing effects and of colors and tints of the face sheet materials and/or the generally fiber or the spun glass insulation fillers for such panels, attractive light-transmitting appearances have been created and tailored to the cutomer requirements in degree of light opacity or transmission.

Such constructions, however, have heretofore been restricted to walls and ceilings or roofs of planar or flat surfaces, though some three-dimensional or corner effects were obtainable by orienting panel sections at angles to one another.

It has now been surprisingly discovered that, despite the flat planar nature of such structural panels, an illusion that the panel surfaces are actually three-dimensional—and, in particular, can appear as a three-dimensional repeating or periodic block structure, such as, for example, zig-zag steps—can be created through a combination of a novel internal construction that permits of a periodic variation in light-transmission color, tint and/or dying of alternate block shapes provided throughout the panel.

This, moreover, has been found to be far more realistic than attempts of an artist to give an impression of three-dimensional steps or other patterns as by painting or decorating on the outer panel sheets; or other prior attempts at decorative architectural panels as in U.S. Pat. No. 3,193,434 wherein a panel is formed of thermoplastic sheet material to produce a pleasing three-dimensional effect; U.S. Pat. No. 2,210,806 wherein a three-dimensional effect is produced by spaced image intercepting elements placed in different planes; U.S. Pat. Nos. 3,940,896 and 4,877,308 employing a glare screen comprising a plurality of angularly offset louvers sandwiched between inner and outer transparent plastic sheets; and other panel structures some having zig-zag members as in U.S. Pat. Nos. 4,516,197; 4,471,596; 3,038,278 and 3,568,387.

Further unlike any of these different prior approaches, the present invention produces an additional illusionary effect when multiple panels of the invention are mounted side-by-side, synergistically producing novel and striking cornering effects with, say, horizontal mounting, and columnar effects with vertical mounting.

The methodology of construction, moreover, enables wide variation of block patterns and the customizing of color and contrasting effects in degree of light transmission and appearance to suit preferences of customers.

Objects of Invention

The principal object of the present invention, accordingly, is to provide a new and improved method of constructing a light-transmitting, preferably insulating, structural panel the outer faces of which, though planar, none-the-less provide the realistic illusion of appearing to be a three-dimensional array of step-like block structures.

A further object is to provide a novel panel construction method and a novel panel that, through internal contrasting alternate-block light-transmitting properties, aided by outer face bonding strips defining the block structure, enable a wide variety of realistically illusory three-dimensional effects to be attained, and on a customized basis, as desired.

Other and further objects will occur to those skilled in this art and are later more fully explained and more particularly pointed out in the appended claims.

SUMMARY

In summary, however, from one of its broader aspects, the invention embraces a method of constructing a light-transmitting structural panel the outer planar faces of which provide the realistic illusion of appearing to be a three-dimensional array of step—like block structures, that comprises, forming a structural frame of dimensions corresponding to those desired for the panel; inserting into the frame a grid core, defining by its outer edges a desired step-like block cell pattern, into the frame and connecting the same thereto; varying the light-transmission within alternate blocks of the core to provide distinct light transmission contrast therebetween; covering opposite faces of the frame with parallel outer light-transmitting sheets; and structurally bonding the sheets to the frame and along the grid core edges as bonding strips outlining such pattern, whereby the resulting light-transmission contrasting block structures, accentuated by the bonding strips, produce the illusion of a three-dimensional step-like block array. Novel three-dimensionally appearing panels are thereby produced.

Preferred and best mode panel designs and construction details are later discussed.

DRAWINGS

The invention will now be described with reference to the accompanying drawings, FIG. 1 of which is a front view of the internal panel grid-core structure of a preferred embodiment of the invention, ready to receive alternately or other periodically contrasting light opaque-transmitting preferably insulation fillings to assist in the achieving the novel results of the invention;

DESCRIPTION OF PREFERRED EMBODIMENT(S)

Figure 1:
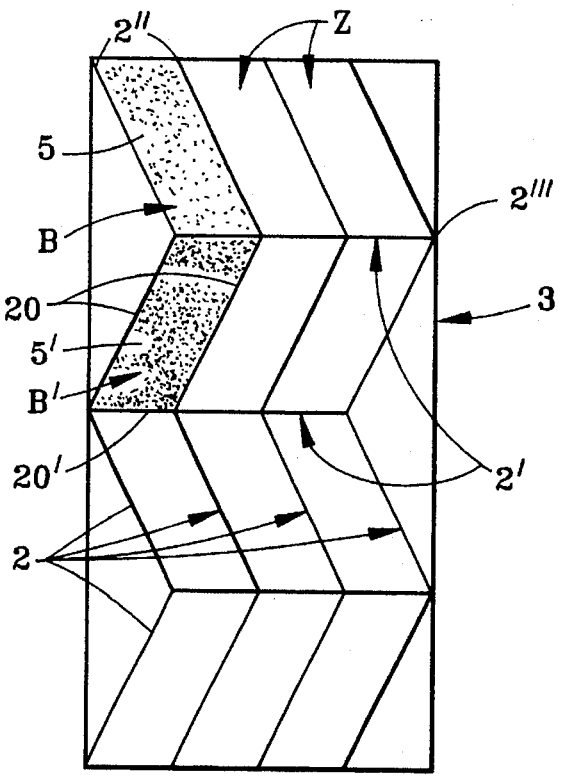
Figure 2:
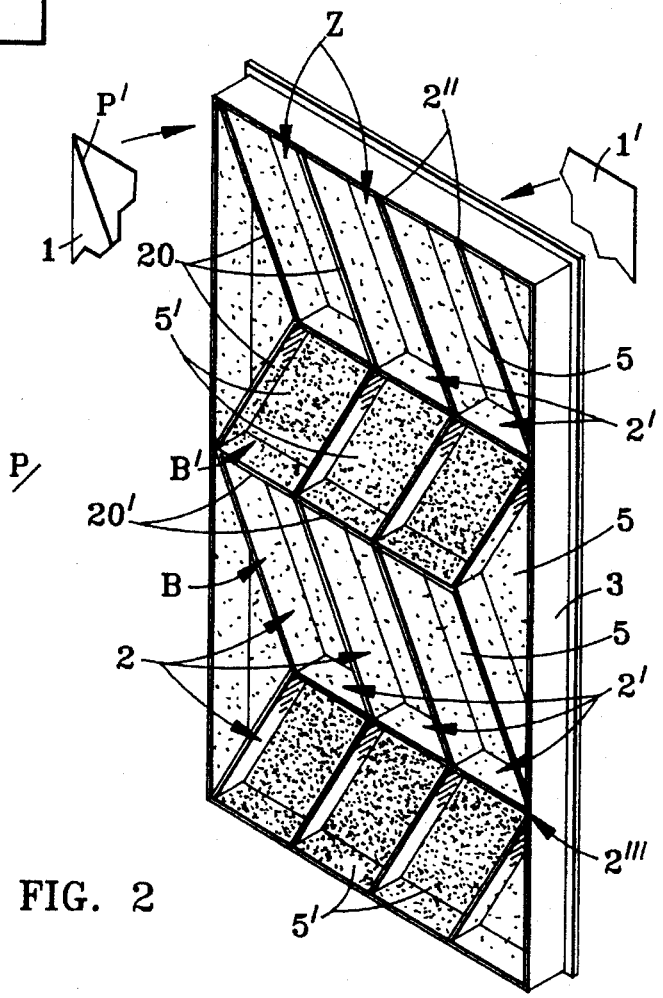
FIG. 2 is an isometric view of the same.

As shown in FIGS. 1 and 2, the invention is illustratively and preferably applied to a rectangular sandwich-type insulating structural wall, ceiling, roof or similar panel 3, as before described, having opposing planar light-transmitting (in any desired degree of opacity) plastic front and rear face sheets fragmentarily shown at 1 and 1' in unassembled state in FIG. 2, as of fiberglass-reinforced polyester sheeting or the like. The face sheets are to be secured over the front and rear surfaces of the panel to close off the rectangular frame 3, as of aluminum or the like, with, for example, spun-glass fiber light-transmitting insulating filler material 5, 5', etc. or the like (in any degree of opacity and with any desired color, tint or dye) packed within the frame between the front and rear face sheets 1 and 1', as later more fully described.

Figure 3:
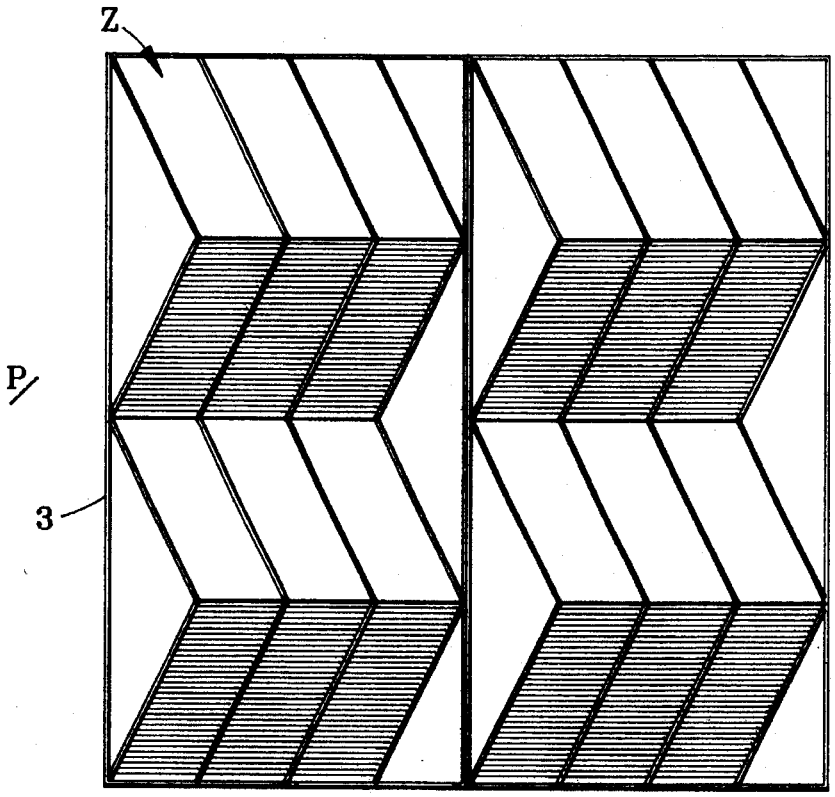
FIG. 3 shows two side-by-side completed similar panels presenting the new three-dimensional step-like illusory appearance effect of the invention.
Figure 4:
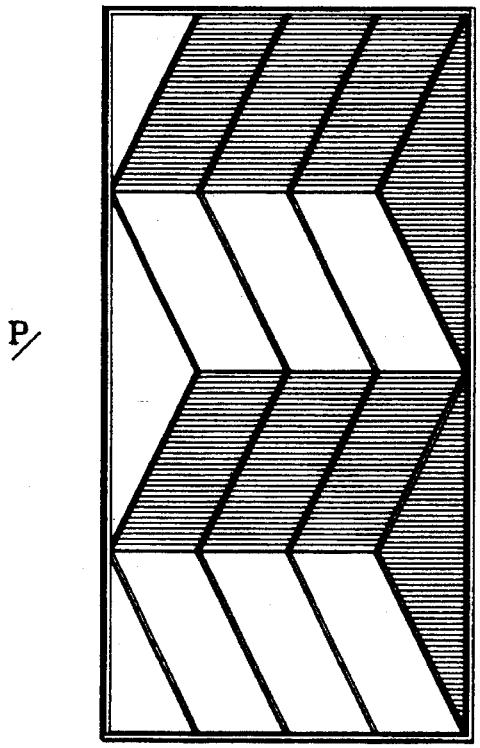
FIG. 4 is a view similar to FIG. 3 showing three light-contrasting zones.

While internal structural supports have heretofore been used in panels to provide panel reinforcement and to contain insulating filler, in accordance with the discovery underlying the present invention, a particular type of patterned internal reinforcing core defining by its outer edges a desired repeating or periodic similar block-like structure, coupled with contrasting or varying light-transmitting properties of alternate adjacent blocks,as by filling the same with light-contrasting fillers, and further aided by contrasting bonding strips holding the edges of the core to the panel face sheets and providing further light-transmission (and color or tint or dye) contrasting strip effects, suprisingly gives rise to an extraordinarily realistic appearance of a three-dimensional step-like block array, FIGS. 3, and 4 instead of the actual planar panel surface.

In the preferred embodiment shown, the block structures B, B' are shown as rectangular, and simulate steps; and, as later described, extending (vertically in FIGS. 1–4) along zig-zag triangular shaped paths Z. It will be evident, however, that other repeating or periodically recurring shapes or geometries and paths may also be employed, as desired, such that the term "block", as used herein, is intended generically to embrace any desired geometrical shapes; and the term "zig-zag" to connote a path of back-and-forth periodicity—not only of substantially triangular repetition, as shown, but sinusoidal and other periodically curving back-and-forth path shapes, as well.

In FIGS. 1 and 2, the rectangular frame 3, as of extruded aluminum framing, defines the dimensions of the desired panel, and contains, inserted therewithin, a first preferably extruded aluminum strip grid 2 of parallel zig-zag spacers, shown extending between opposing upper and lower sides of the frame 3 along vertical zig-zag paths Z, and structurally connected to the frame sides as at 2", such as by clips, screws or bonding or the like. An interlocking second extruded aluminum strip grid of horizontally parallel spacers 2' is shown similarly inserted and connected within the frame, intersecting the zig-zag spacers 2 and extending parallel to the upper and lower sides of the frame, shown connected at right angles to the left and right frame sides as at 2'", such that the grids 2 and 2' together form a panel grid core, the exposed or outer edges 20–20' of which define a desired step-like zig-zag block cell pattern P—in this case, in the form of substantially equal-dimensioned similar rectangular-shape similar block "steps".

Preferably, though not in all cases essentially, the fiberglass-reinforced polyester light-transmitting front and/or rear faces 1 and 1' may be decorated, as by painting, to reproduce this same step-like zig zag block pattern P' (FIG. 2) so that, when assembled, this will aline with the bonding strips of the grid core pattern P.

The block cells B, B' are, as before described, filled with insulating filler, such as the before-mentioned insulating spun glass batte. By using contrasting filler 5,5', as by color variation (including tinting, shadowing and dyeing within the meaning of "coloring" or "color") or, shading variation, or density, or material variation in alternate blocks B, B', the alternate or adjacent blocks B, B' along the path Z will assume different degrees of light-transmission appearance, and contrasting effects can be obtained in the alternate or adjacent blocks of the repeating or periodic zig-zag pattern, as more particularly shown in FIGS. 3 and 4. The illusory effect of adjacent stacked and alined three-dimensional steps having substantially isosceles triangular side surfaces is thereby attained. This enables providing distinct and repeating light-transmission contrast between the adjacent blocks which produces the depth illusion phenomenon underlying the invention, and that gives rise to the apppearance of the illusory three-dimensional zig-zag block array. With light transmitting (diffuse) spun glass fiber, for example, of the Type RAH, of Kalwall Corporation of Manchester, New Hampshire, the contrast in light transmission of the internal filler in one block contrasts strikingly with dark or black pigmented filler, as shown in FIGS. 3 and 4—the latter showing also third contrasting triangular blocks at the far right; and other different transmission properties and contrasting can be attained with other color dyes, as well.

The face sheets 1 and 1' are then adhesively bonded to the frame, FIG. 3, and the edges 20, 20' of the grid core 2–2' forming bonding strips outlining their step-like block cell patterns P; and, with appropriate coloring accentuating the contrasting block structures to aid in the illusion of the three-dimensional step-like block array. Suitable adhesives, for example may be modified acrylic types or the like.

A most attractive "three dimensional" sandwich panel of this character may employ a bright or "crystal" surface outer panel sheet 1, with a flat white or other dull or other surface appearance provided on the rear face 1' of the panel. Other combinations, contrasts, colors and effects may readily be provided, as desired.

A further illusionary synergism has been found to occur when two or more panels of the invention are mounted side by side as in FIG. 3. In horizontal position, the effect occurs of a corner being created; and, in vertical orientation, as shown, columnar and triangular effects occur. The three-dimensional visual effect, moreover, pleasingly seems to change as the panel is viewed from different angles.

Further modifications will occur to those skilled in this art, and such as considered to fall within the spirit and scope of the invention as defined in the appended claims.

What is claimed is:

1. A method of constructing a light-transmitting structural panel the outer planar faces of which provide the realistic illusion of appearing to be a three-dimensional array of step-like block structures, that comprises, forming a structural frame of dimensions corresponding to those desired for the panel; inserting into the frame a grid core, defining by its outer edges a desired step-like block cell pattern, and connecting the core thereto; providing varied light-transmission within alternate blocks of the core to provide distinct light-transmission contrast therebetween; covering opposite faces of the frame with parallel outer light-transmitting sheets; and structurally bonding the sheets to the frame and along the gird core edges as bonding strips outlining said pattern, whereby the resulting light-transmission contrasting block structures, accentuated by the bonding strips, produce the illusion of a three-dimensional step-like array; and including the step of coloring the bonding strips to add to the contrasting block appearance.

2. A method as claimed in claim 1 and in which the varying of light-transmission of the blocks is achieved by the step of filling the cells of the grid core with material of varying light-transmitting properties.

3. A method as claimed in claim 2, and additionally causing the filling material and the bonding strips to be tinted, colored or dyed to aid in producing light-transmission and contrasting block appearance.

4. A method as claimed in claim 3 and including filling the cell with insulating material of differing degrees of light transmission.

5. A method as claimed in claim 4 and including the step of providing the front outer sheet with a bright-appearing surface and the rear outer sheet with a flat or dull surface.

6. A method as claimed in claim 1 and including the step of mounting the structural panel side-by-side with one or more similar panels to provide a further illusion of columnar or corner-like appearance.

7. A method of constructing a light transmitting structural panel the outer planar faces of which provide the realistic illusion of appearing to be a three-dimensional array of step-like block structures, that comprises, forming a structural frame of dimensions corresponding to those desired for the panel; inserting into the frame a grid core, defining by its outer edges a desired step-like block cell pattern, and connecting the core thereto; providing varied light-transmission within alternate blocks of the core to provide distinct light-transmission contrast therebetween; covering opposite faces of the frame with parallel outer light-transmitting sheets; and structurally bonding the sheets to the frame and along the grid core edges as bonding strips outlining said pattern, whereby the resulting light-transmission contrasting block structures, accentuated by the bonding strips, produce the illusion of a three-dimensional step-like array, and including the step of reproducing the pattern on the outer sheets alined with the grid core edges and the frame before said bonding.

8. A method of constructing a light-transmitting insulating structural panel the outer faces of which provide the realistic illusion of appearing to be a three dimensional array of zig-zag step-like block structures, that comprises, forming a structural rectangular frame comprising pairs of opposing sides of width corresponding to the desired width of the panel; inserting within the frame a first grid of parallel zig-zag spacers extending between and structurally connected with one pair of the opposing sides of the frame, and an interlocking second grid of parallel spacers intersecting the zig-zag spacers and extending between the other pair of opposing sides of the frame, such that the first and second grids form a panel grid core the outer edges of which define a desired step-like zig-zag block cell pattern; reproducing the step-like zig-zag block pattern on one or more of a pair of light-transmitting sheets that are to serve as parallel opposing outer faces of the panel; filling the block cells with light-transmitting insulating material; varying the light-transmission of the material within alternate blocks of the zig-zag pattern to provide distinct and periodically repeating light-transmission contrast therebetween; covering opposite faces of the frame with the light-transmitting sheets and structurally bonding the sheets to corresponding opposite edges of the frame and to the edges of the first and second grids as bonding strips outlining said pattern, whereby the resulting light-transmission contrasting block structures, accentuated by the bonding strips, produce the illusion of a three-dimensional zig-zag block array; and including the step of coloring the bonding strips to add to the contrasting block appearance.

9. A method as claimed in claim 8 and in which the varying of light-transmission of the filling material is achieved by the step of one of tinting, coloring, shadowing or dyeing.

10. A method as claimed in claim 9 and including the step of providing the front outer sheet with a bright-appearing surface and the rear outer sheet with a flat or dull surface.

11. A method as claimed in claim 9 and including the step of mounting the structural pattern side-by-side with one or more singular panels to provide a further illusion of columnar or corner-like appearance.

12. A method of constructing a light-transmitting insulating structural panel the outer faces of which provide the realistic illusion of appearing to be a three dimensional array of zig-zag step-like block structures, that comprises, forming a structural rectangular frame comprising pairs of opposing sides of width corresponding to the desired width of the panel; inserting within the frame a first grid of parallel zig-zag spacers extending between and structurally connected with one pair of the opposing sides of the frame, and an interlocking second grid of parallel spacers intersecting the zig-zag spacers and extending between the other pair of opposing sides of the frame, such that the first and second grids form a panel grid core the outer edges of which define a desired step-like zig-zag block cell pattern; reproducing the step-like zig-zag block pattern on one or more of a pair of light-transmitting sheets that are to serve as parallel opposing outer faces of the panel; filling the block cells with light-transmitting insulating material; varying the light-transmission of the material within alternate blocks of the zig-zag pattern to provide distinct and periodically repeating light-transmission contrast therebetween; covering opposite faces of the frame with the light-transmitting sheets and structurally bonding the sheets to corresponding opposite edges of the frame and to the edges of the first and second grids as bonding strips outlining said pattern, whereby the resulting light-transmission contrasting block structures, accentuated by the bonding strips, produce the illusion of a three-dimensional zig-zag block array, and including the step of coloring the bonding strips to add to the contrasting block appearance.

13. A light transmitting structural panel the outer faces of which provide the illusion of appearing to be a three-dimensional array of step-like block structures, the panel having in combination, a structural frame of dimensions defining those of the panel; a grid core defining by its outer edges a desired step-like block cell pattern inserted within and connected to the frame; material of different light-transmitting properties inserted within alternate blocks of the core, providing distinct and periodically repeating light-transmission contrast therebetween; and front and rear outer light-transmitting panel sheets bonded to the frame and along the grid core edges as bonding strips outlining said pattern, whereby the resulting light-transmission contrasting block structures, accentuated by the bonding strips, produce the illusion of a three-dimensional step-like block array; and in which at least one of the filling material and the bonding strips is one of tinted, colored, shadowed or dyed, respectively to achieve varying light transmission and to add to the contrasting block appearance.

14. A panel as claimed in claim 13 and in which the said material in alternate blocks of the core are of different tint, color, shadow or dye in a periodically repeating manner.

15. A panel as claimed in claim 14 and in which the frame is of substantially rectangular shape and the block structures are also of substantially rectangular shape.

16. A panel as claimed in claim 15 and in which the said step-like block cell pattern is of zig-zag configuration extending along the panel, providing the appearance of three-dimensional zig-zag steps.

17. A panel as claimed in claim 16 and in which the zig-zag steps are of equal dimensions and extend in adjacent parallel zig-zag paths that appear as adjacent stacked and alined three-dimensional steps having isosceles triangular side surfaces.

18. A panel as claimed in claim 17 and in which the panel is mounted side-by-side with one or more similar panels to provide a further illusion of columnar or corner-like appearance.

19. A panel as claimed in claim 13 and in which the front outer panel sheet is provided with a bright-appearing surface and the rear sheet with a flat or dull surface.

20. A light transmitting structural panel the outer faces of which provide the illusion of appearing to be a three-dimensional array of step-like block structures, the panel having, in combination, a structural frame of dimensions defining those of the panel; a grid core defining by its outer edges a desired step-like block cell pattern inserted within and connected to the frame; material of different light-transmitting properties inserted within alternate blocks of the core, providing distinct and periodically repeating light-transmission contrast therebetween; and front and rear outer light-transmitting panel sheets bonded to the frame and along the grid core edges as bonding strips outlining said pattern; whereby the resulting light-transmission contrasting block structures, accentuated by the bonding strips, produce the illusion of a three-dimensional step-like block array, and in which the said materials in alternate blocks of the core are of different tint, color, shadow or dye in a periodically repeating manner, and in which the said material comprises spun glass insulating light-transmitting batte material.

21. A light transmitting structural panel the outer faces of which provide the illusion of appearing to be a three-dimensional array of step-like block structures, the panel having, in combination, a structural frame of dimensions defining those of the panel; a grid core defining by its outer edges a desired step-like block cell pattern inserted within and connected to the frame; material of different light-transmitting properties inserted within alternate blocks of the core, providing distinct and periodically repeating light-transmission contrast therebetween; and front and rear outer light-transmitting panel sheets bonded to the frame and along the grid core edges as bonding strips outlining said pattern, whereby the resulting light-transmission contrasting block structures, accentuated by the bonding strips, produce the illusion of a three-dimensional step-like block array, and in which the said material in alternate blocks of the core are of different tint, color, shadow or dye in a periodically repeating manner, and in which the said step-like block pattern is reproduced on one or both of the panel sheets, with the reproduction aligned with the edges of the grid core.

* * * * *